US009556687B2

(12) United States Patent
Buytaert et al.

(10) Patent No.: US 9,556,687 B2
(45) Date of Patent: Jan. 31, 2017

(54) MULTI-VANE CENTRALIZER AND METHOD OF FORMING

(71) Applicant: Antelope Oil Tool & Mfg. Co., LLC, Mineral Wells, TX (US)

(72) Inventors: Jean Buytaert, Mineral Wells, TX (US); Clayton Plucheck, Tomball, TX (US); Ira Eugene Hining, Houston, TX (US)

(73) Assignee: ANTELOPE OIL TOOL & MFG. CO., Mineral Wells, TX (US)

( * ) Notice: Subject to any disclaimer, the term of this patent is extended or adjusted under 35 U.S.C. 154(b) by 251 days.

(21) Appl. No.: 14/461,282

(22) Filed: Aug. 15, 2014

(65) Prior Publication Data

US 2015/0047855 A1 Feb. 19, 2015

Related U.S. Application Data

(60) Provisional application No. 61/872,267, filed on Aug. 30, 2013, provisional application No. 61/867,023, filed on Aug. 17, 2013.

(51) Int. Cl.
*E21B 17/10* (2006.01)

(52) U.S. Cl.
CPC ..... *E21B 17/1078* (2013.01); *E21B 17/1014* (2013.01); *E21B 17/1028* (2013.01)

(58) Field of Classification Search
CPC ..... E21B 17/1014; E21B 17/1028; E21B 17/1078
See application file for complete search history.

(56) References Cited

U.S. PATENT DOCUMENTS 1,201,706 A 10/1916 Dodge
2,368,401 A 1/1945 Baker
2,496,402 A 2/1950 McVeigh et al.
(Continued)

FOREIGN PATENT DOCUMENTS

EP 0079702 A1 5/1983
EP 0088507 A1 9/1983
(Continued)

OTHER PUBLICATIONS

Jong Kyung Lee (Authorized Officer), International Search Report and Written Opinion dated Nov. 20, 2014, International Application No. PCT/US2014/051364, filed Aug. 15, 2014, pp. 1-16.
(Continued)

*Primary Examiner* — William P Neuder
(74) *Attorney, Agent, or Firm* — MH2 Technology Law Group, LLP

(57) ABSTRACT

A centralizer for centralizing a tubular in a wellbore, and a method of manufacturing a centralizer. The centralizer may include a plurality of ribs spaced circumferentially apart from one another around the tubular. Each of the ribs may include a first end section, a second end section, and a middle section extending between the first and second end sections. A first plurality of spacers may be spaced circumferentially apart from one another around the tubular. Each of the first plurality of spacers may be positioned circumferentially between two of the plurality of ribs. The first plurality of spacers and the first end sections of the plurality of ribs may be axially aligned and together at least partially define a first end collar.

22 Claims, 11 Drawing Sheets

(56) References Cited

U.S. PATENT DOCUMENTS

| | | | | |
|---|---|---|---|---|
| 2,797,756 | A | 7/1957 | Hall, Sr. | |
| 2,824,613 | A | 2/1958 | Baker et al. | |
| 3,040,405 | A | 6/1958 | Solum | |
| 2,855,052 | A | 10/1958 | Wright et al. | |
| 2,962,313 | A | 11/1960 | Conrad | |
| 2,986,417 | A | 5/1961 | Baker | |
| 3,063,760 | A | 11/1962 | Gifford | |
| 3,124,196 | A | 3/1964 | Solum | |
| 3,292,708 | A | 12/1966 | Mundt | |
| 3,360,846 | A | 1/1968 | Schellstede et al. | |
| 3,563,575 | A | 2/1971 | Sanford | |
| 3,566,965 | A | 3/1971 | Solum | |
| 3,652,138 | A | 3/1972 | Collett | |
| 3,916,998 | A | 11/1975 | Bass, Jr. et al. | |
| 4,146,060 | A | 3/1979 | Garrett | |
| 4,363,360 | A | 12/1982 | Richey | |
| 4,367,053 | A | 1/1983 | Stratienko et al. | |
| 4,434,125 | A | 2/1984 | Lavender et al. | |
| 4,531,582 | A | 7/1985 | Muse et al. | |
| 4,651,823 | A * | 3/1987 | Spikes | E21B 17/1028 166/241.7 |
| 4,909,322 | A * | 3/1990 | Patterson | E21B 17/1028 166/241.7 |
| 5,501,281 | A | 3/1996 | White et al. | |
| 5,517,878 | A | 5/1996 | Klein et al. | |
| 5,520,422 | A | 5/1996 | Friedrich et al. | |
| 5,698,055 | A | 12/1997 | Benkoczy | |
| 5,706,894 | A | 1/1998 | Hawkins, III | |
| 5,743,302 | A | 4/1998 | McNeely | |
| 5,817,952 | A | 10/1998 | Swisher et al. | |
| 5,860,760 | A | 1/1999 | Kirk | |
| 5,908,072 | A | 6/1999 | Hawkings | |
| 6,361,243 | B1 | 3/2002 | Geib | |
| 6,484,803 | B1 | 11/2002 | Gremillion | |
| 6,679,325 | B2 | 1/2004 | Buytaert | |
| 6,679,335 | B2 | 1/2004 | Slack et al. | |
| 6,957,704 | B2 | 10/2005 | Rogers et al. | |
| 7,159,619 | B2 | 1/2007 | Latiolais, Jr. et al. | |
| 8,146,662 | B2 | 4/2012 | Shoemate | |
| 8,251,138 | B2 | 8/2012 | Bonner | |
| 8,291,971 | B2 | 10/2012 | Lopez | |
| 2001/0040041 | A1 | 11/2001 | Pennington et al. | |
| 2002/0139537 | A1 | 10/2002 | Young et al. | |
| 2003/0019637 | A1 | 1/2003 | Slack et al. | |
| 2003/0070803 | A1* | 4/2003 | Gremillion | E21B 17/1028 166/241.6 |
| 2008/0156488 | A1 | 7/2008 | Thornton | |
| 2009/0229823 | A1 | 9/2009 | Moen et al. | |
| 2009/0255666 | A1 | 10/2009 | Olsen et al. | |
| 2009/0308615 | A1* | 12/2009 | Buytaert | E21B 17/1028 166/378 |
| 2010/0018698 | A1* | 1/2010 | Garner | E21B 17/1078 166/241.6 |
| 2010/0326671 | A1 | 12/2010 | Buytaert et al. | |
| 2012/0006533 | A1 | 1/2012 | Barnard et al. | |
| 2012/0073803 | A1 | 3/2012 | Dalmia | |
| 2012/0227959 | A1 | 9/2012 | Buytaert et al. | |

FOREIGN PATENT DOCUMENTS

| | | | |
|---|---|---|---|
| GB | 2304753 | A | 3/1997 |
| WO | 2007143324 | A1 | 12/2007 |

OTHER PUBLICATIONS

Patrizia Lindquist (Authorized Officer), PCT Invitation to Pay Additional Fees dated Oct. 20, 2010, PCT Application No. PCT/US2010/037441, filed Jun. 4, 2010, pp. 1-6.

Patrizia Lindquist (Authorized Officer), PCT International Search Report and Written Opinion dated Dec. 23, 2010, PCT Application No. PCT/US2010/037441, filed Jun. 4, 2010, pp. 1-16.

Author Unknown, Frank's Anaconda Stop Collar Sheet, Frank's Casing Crew & Rental Tools, Inc., Lafayette, LA, 2003, 1 page.

Non-Final Office Action dated Sep. 13, 2012, U.S. Appl. No. 12/756,177, filed Apr. 8, 2010, pp. 1-9.

Final Office Action dated Feb. 1, 2013, U.S. Appl. No. 12/756,177, filed Apr. 8, 2010, pp. 1-12.

Non-Final Office Action dated Aug. 14, 2013, U.S. Appl. No. 12/756,177, filed Apr. 8, 2010, pp. 1-11.

Final Office Action dated Mar. 13, 2014, U.S. Appl. No. 12/756,177, filed Apr. 8, 2010, pp. 1-11.

Jean Buytaert et al., "Wrap-Around Stop Collar and Method of Forming", U.S. Appl. No. 14/461,273, filed Aug. 15, 2014.

Jean Buytaert et al., "Wrap-Around Band Tool Connector and Method of Forming", U.S. Appl. No. 14/461,292, filed Aug. 15, 2014.

Brent James Lirette et al., "Wrap Around Band and Sleeve Attachment Apparatus for an Oilfield Tubular", U.S. Appl. No. 14/461,297, filed Aug. 15, 2014.

Non-Final Office action dated Feb. 16, 2016, U.S. Appl. No. 14/461,297, filed Aug. 15, 2014, pp. 1-8.

International Search Report and Written Opinion dated Nov. 26, 2014 from International Application No. PCT/US2014/051358, pp. 1-9.

* cited by examiner

SECTION A-A

MULTI-VANE CENTRALIZER AND METHOD OF FORMING

CROSS-REFERENCE TO RELATED APPLICATIONS

This application claims the benefit of U.S. Provisional Patent Application having Ser. No. 61/872,267 filed on Aug. 30, 2013, and U.S. Provisional Patent Application having Ser. No. 61/867,023, filed Aug. 17, 2013. The entirety of each of these provisional applications is incorporated herein by reference.

BACKGROUND

An oilfield tubular (e.g., pipe, drill string, casing, tubing) may be placed in a wellbore to transport fluids into the wellbore or to produce water, oil, and/or gas from geologic formations. The wellbore may be cased with the oilfield tubular to prevent collapse of the wellbore and to facilitate deeper or horizontal drilling. This may include positioning and/or cementing the oilfield tubular concentrically within the wellbore or a section of another oilfield tubular.

In casing operations, a number of devices are generally coupled to the oilfield tubular. For example, a centralizer may be coupled to the tubular, so as to provide an annulus, sometimes also referred to as an annular "standoff" between the oilfield tubular and the surrounding tubular. One type of centralizer is a bow-spring centralizer, which includes end collars and flexible bow-springs that extend therebetween. The bow-springs are curved radially outward from the casing, so as to engage the wellbore or another tubular that surrounds the casing. Further, the bow-springs are resilient, allowing the centralizer to fit through a range of surrounding tubular sizes (e.g., restrictions), while still ensuring the annular standoff between the casing and the surrounding tubular.

SUMMARY

A centralizer for centralizing a tubular in a wellbore is disclosed. The centralizer may include a plurality of ribs spaced circumferentially apart from one another around the tubular. Each of the ribs may include a first end section, a second end section, and a middle section extending between the first and second end sections. A first plurality of spacers may be spaced circumferentially apart from one another around the tubular. Each of the first plurality of spacers may be positioned circumferentially between two of the plurality of ribs. The first plurality of spacers and the first end sections of the plurality of ribs may be axially aligned and together at least partially define a first end collar.

In another embodiment, the centralizer may include a plurality of ribs spaced circumferentially apart from one another around the tubular. Each of the ribs may include a first end section, a second end section, and a middle section extending between the first and second end sections. The first end section, the second end section, or both may include an inner surface and an outer surface. The inner surface may contact an outer surface of the tubular. The inner surface may define a first recess that extends radially outward with respect to a longitudinal axis of the tubular. The first recess may at least partially receive a protrusion extending radially outward from the outer surface of the tubular. The outer surface may define a first groove that extends radially inward with respect to the longitudinal axis of the tubular. The middle section may have a bow shape and be configured to engage a surrounding tubular in the wellbore. A plurality of spacers may be spaced circumferentially apart from one another around the tubular. Each of the plurality of spacers may be positioned circumferentially between two of the plurality of ribs. The plurality of spacers and the first end sections of the plurality of ribs together may at least partially define a first end collar. An elongated flexible member may be wrapped around the tubular and the plurality of ribs, and the elongated flexible member may be positioned at least partially within the first groove.

A method of forming a centralizer on a tubular is also disclosed. The method may include placing a plurality of ribs on an outer surface of the tubular. The ribs may each include first and second end sections and a middle section extending between the first and second end sections. The middle section may be configured to engage a surrounding tubular when the centralizer is deployed into a wellbore. A plurality of spacers may be placed on the outer surface of the tubular. Each of the plurality of spacers may be positioned between two of the plurality of ribs. The plurality of spacers and the first end sections of the plurality of ribs together may at least partially define a first end collar. The plurality of spacers and the plurality of ribs may be secured around the tubular.

BRIEF DESCRIPTION OF THE DRAWINGS

The disclosure may best be understood by referring to the following description and accompanying drawings that are used to illustrate embodiments of the disclosure. In the drawings.

DETAILED DESCRIPTION

Figure 1B:
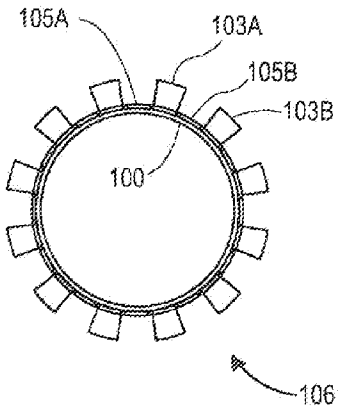
FIG. 1B illustrates an end view of a plurality of ribs and a plurality of spacers installed around the oilfield tubular, according to an embodiment.

The following disclosure describes several embodiments for implementing different features, structures, or functions of the present disclosure. These embodiments are provided merely as examples and are not intended to limit the scope of the disclosure. Additionally, the present disclosure may repeat reference characters (e.g., numerals) and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such the naming convention for the elements described herein is not intended to limit the scope of the disclosure, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. The term "oilfield tubular" may include a pipe, tubular, tubular member, easing, liner, tubing, drill pipe, drill string, and other like terms. These terms may be used in combination with the term "joint" to refer to a single unitary length, the term "stand" to refer to one or more, and typically two or three, interconnected joints, or the term "string" to refer to two or more interconnected joints. The oilfield tubular may be of any length, for example, about 30 feet to about 90 feet. The longitudinal outer cross-section of the oilfield tubular may be circular, square, rectangular, ovate, irregular, polygonal, egg-shaped, etc. In one embodiment, the oilfield tubular may have a circular outer cross-section having a diameter between about five inches and about twenty inches.

Figure 1A:
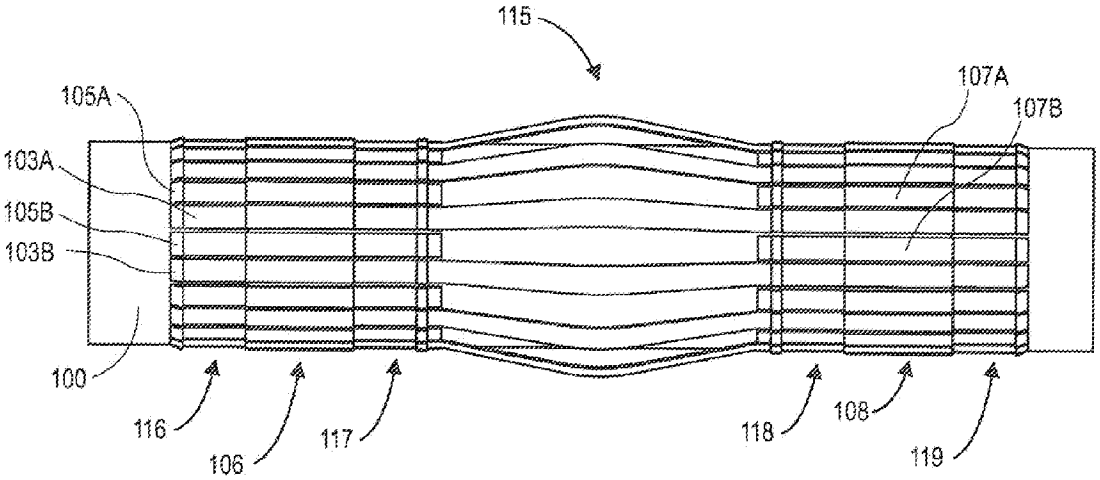
FIG. 1A depicts an initial, installation configuration in a method of forming a centralizer, according to an embodiment.

FIG. 1A depicts an initial, installation configuration in a method of forming a centralizer. A plurality of ribs (two are labelled: 103A, 103B) and a plurality of spacers (four are labelled: 105A, 105B, 107A, 107B) may be installed around an oilfield tubular 100. The ribs 103A, 103B may be circumferentially offset from one another around the oilfield tubular 100. One or more of the spacers (e.g., 105B) may be positioned circumferentially between each adjacent pair of ribs 103A, 103B. The ribs 103A, 103B and the spacers 105A, 105B, 107A, 107B may be configured to move axially and/or rotationally with respect to the oilfield tubular 100.

The ribs 103A, 103B may be separate components (e.g., not one integral piece). Each rib 103A, 103B may include a first collar section 106, a second collar section 108, and a bow section 115 positioned therebetween. As shown, the ribs 103A, 103B are each substantially identical; however, in other embodiments, the ribs 103A, 103B may differ (e.g., differing widths, thicknesses, and/or shapes).

The spacers 105A, 105B may be substantially axially aligned with the first collar sections 106 of the ribs 103A, 103B, and the spacers 107A, 107B may be substantially axially aligned with the second collar sections 108 of the ribs 103A, 103B. Together, the first collar sections 106 and the spacers 105A, 105B may form a first collar around the circumference of the oilfield tubular 100, and the second collar sections 108 and the spacers 107A, 107B may form a second collar around the circumference of the oilfield tubular 100.

In at least one embodiment, the spacers 105A, 105B, 107A, 107B may be unitary with the ribs 103A, 103B. In other embodiments, the spacers 105A, 105B, 107A, 107B may be welded to the ribs 103A, 103B or otherwise fastened thereto, e.g., prior to installation around the oilfield tubular 100. As shown, the spacers 105A, 105B, 107A, 107B may be substantially identical; however, in other embodiments, the spacers 105A, 105B, 107A, 107B may differ (e.g., differing widths and/or thicknesses).

The ribs 103A, 103B and/or spacers 105A, 105B, 107A, 107B may be retained in the installed position during installation by a clamp, an elastic band, or any other retaining means known in the art. When a clamp is used, the clamp may be positioned around the circumference of the ribs 103A, 103B and/or the spacers 105A, 105B, 107A, 107B. When an elastic band is used, the band may flex to allow for insertion and removal of ribs 103A, 103B and/or the spacers 105A, 105B, 107A, 107B while retaining others in place around the oilfield tubular 100.

The abutting of a rib (e.g., rib 103A) and a spacer (e.g., spacer 105A) may define an axial split parallel to the longitudinal axis of the oilfield tubular 100. This may facilitate the installation of the ribs 103A, 103B from a lateral position. Although the axial split is shown as extending parallel to the longitudinal axis, it may be helical or otherwise angled with respect to the longitudinal axis and/or shaped. Suitable shapes may include a saw tooth or other interlocking interface between adjacent ribs 103A, 103B and/or spacers 105A, 105B, 107A, 107B.

The outer surfaces of the ribs 103A, 103B and spacers 105A, 105B, 107A, 107B may include grooves 116, 117, 118, 119 formed therein, as shown in FIG. 1A. For example, the grooves 116, 117, 118, 119 may collectively form a circumferential groove around the oilfield tubular 100. In an embodiment, the collar sections 106, 108 may each include at least one of the grooves 116, 117, 118, 119. As shown, each collar section (e.g., collar section 106) may have multiple grooves (e.g., 116, 117) that are axially offset from one another. The grooves 116, 117, 118, 119 may be formed (e.g., by machining, bending, etc.) in the ribs 103A, 103B and/or the spacers 105A, 105B, 107A, 107B.

The ribs 103A, 103B may be flexible or rigid. In an embodiment, the ribs 103A, 103B may be at least partially bow-shaped, e.g., at the bow section 115 thereof, as shown. Accordingly, the ribs 103A, 103B may flex radially outwards and collapse radially inwards, thereby applying a resilient force against a surrounding tubular across a range of diameters, so as to provide an annular standoff between the oilfield tubular 100 and the surrounding tubular. As used herein, "surrounding tubular" refers to a component in the wellbore (e.g., a casing, a liner, etc.) or the wellbore wall (e.g., an open hole). In other embodiments, however, the ribs 103A, 103B may be flat or otherwise shaped, for example, as a rigid centralizer, such that the thickness of the ribs 103A, 103B provides the standoff. The ribs 103A, 103B may have beveled edges and/or have a curved outer surface to provide substantially uniform contact with a surrounding tubular that the ribs 103A, 103B contact. The ribs 103A, 103B may be unitary and have the first collar section 106, the second collar section 108, and the bow section 115 that are formed from one piece of material. The ribs 103A, 103B may be formed from steel, beryllium copper alloy, composites (e.g., carbon fiber or another fiber-reinforced polymer), other elastically and/or plastically deformable materials, or any combinations thereof. Further, the ribs 103A, 103B may be heat-treated or otherwise treated, before or after installation, to take on certain metallurgical properties, such as enhanced elasticity, restoration forces, and/or the like.

With continuing reference to FIG. 1A, FIG. 1B illustrates an end view of the ribs 103A, 103B and the spacers 105A, 105B, 107A, 107B around the oilfield tubular 100, according to an embodiment. The number of ribs 103A, 103B and/or spacers 105A, 105B, 107A, 107B is not limited to those depicted. Further, although the ribs 103A, 103B and spacers 105A, 105B, 107A, 107B are illustrated as being alternating (e.g., a rib 103A between two spacers 105A, 105B), the ribs 103A, 103B may abut other ribs 103A, 103B and/or the spacers 105A, 105B, 107A, 107B may abut other spacers 105A, 105B, 107A, 107B.

Figure 2A:
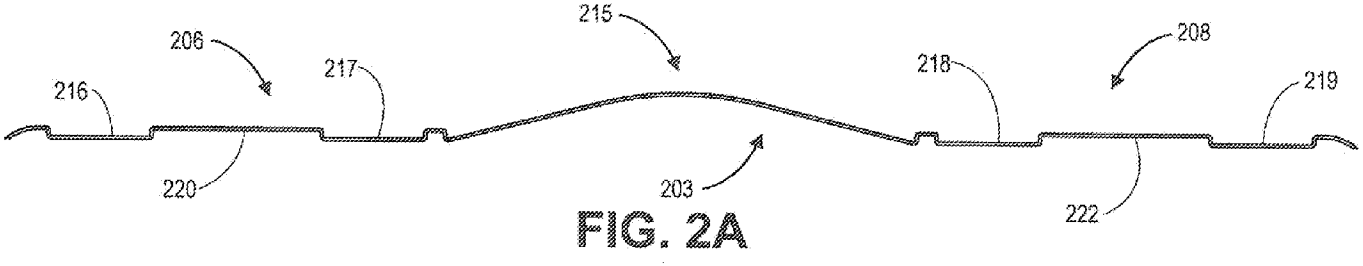
FIG. 2A illustrates a side view of a rib, according to an embodiment.
Figure 2B:
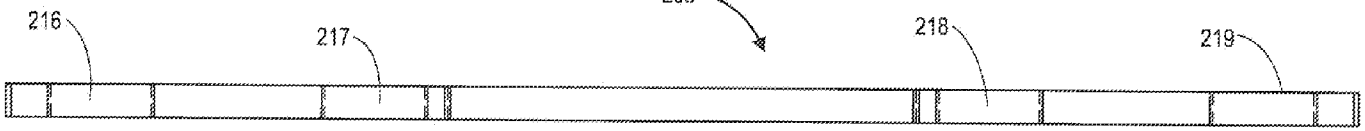
FIG. 2B illustrates a top view of the rib, according to an embodiment.

FIGS. 2A and 2B illustrate a side view and a top view, respectively, of a rib 203, according to one embodiment. The rib 203 includes a bow section 215, a first collar section 206, and a second collar section 208. In other embodiments, a straight or flat section may be used in lieu of the bow section 215, such as for a rigid centralizer. The first collar section 206 may include a recess 220 in an inner surface thereof that extends radially outward with respect to a longitudinal axis of the oilfield tubular 100. The second collar section 208 may include a recess 222 in an inner surface thereof that extends radially outward with respect to the longitudinal axis of the oilfield tubular 100. The recesses 220, 222 may be formed in any way, for example, by bending or stamping a uniform thickness of material or by machining down a thickness of material to provide the recess therein. The ends of the rib 203 may be tapered or beveled. The rib 203 may be formed into the desired shape from a uniform thickness of material by plastic deformation or bending.

The rib 203 may include grooves 216, 217, 218, 219 in an outer surface thereof that extend radially inward with respect to the longitudinal axis of the oilfield tubular 100. For example, the rib 203 may have a single groove or multiple grooves 216, 217, 218, 219. The rib 203 in FIG. 2B has a substantially uniform width along its axial length. In other embodiments, the rib 203 may have a non-uniform width along its axial length.

Figure 3:
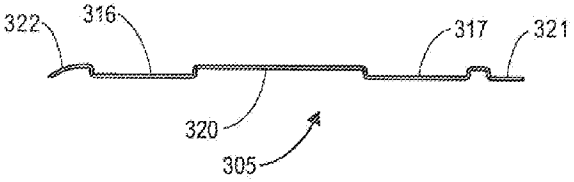
FIG. 3 illustrates a side view of a first spacer, according to an embodiment.
Figure 4:
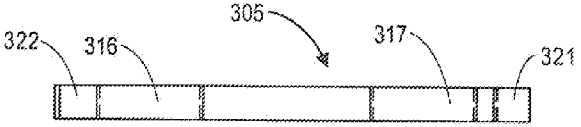
FIG. 4 illustrates a top view of the first spacer, according to an embodiment.

FIGS. 3 and 4 illustrate a side view and a top view, respectively, of a spacer 305, according to an embodiment. The spacer 305 may include a recess 320 in an inner surface thereof. The recess 320 may extend radially outward with respect to the longitudinal axis of the oilfield tubular 100 (see FIG. 1) when the spacer 305 is coupled to the oilfield tubular 100. The spacer 305 may also have one or more grooves 316, 317 in an outer surface thereof. The grooves 316, 317 may extend radially inward with respect to the longitudinal axis of the oilfield tubular 100 (see FIG. 1) when the spacer 305 is coupled to the oilfield tubular 100. The recess 320 and/or the grooves 316, 317 may be formed in any way, for example, by bending a strip (e.g., with a generally uniform thickness) of material or by machining a thickness of material.

As shown, a first end 321 of the spacer 305 may be straight, and a second end 322 of the spacer 305 may be tapered or beveled. However, as will be appreciated, in other embodiments, both ends 321, 322 may be straight, or both ends 321, 322 may be beveled. The spacer 305 may be formed into the desired shape from a uniform thickness of material, e.g., by plastic deformation, bending, machining, etc.

The collar sections 106, 108 of the ribs 203 and spacers 305 may each define the same or a similar maximum positive outer protrusion (e.g., a total radial thickness, accounting for radially-outward protrusions, etc.). In at least one embodiment, the collars (i.e., the collar sections 206, 208 and the spacers 305) may define a uniform profile having substantially the same positive outer protrusion around the oilfield tubular 100.

Figure 5A:
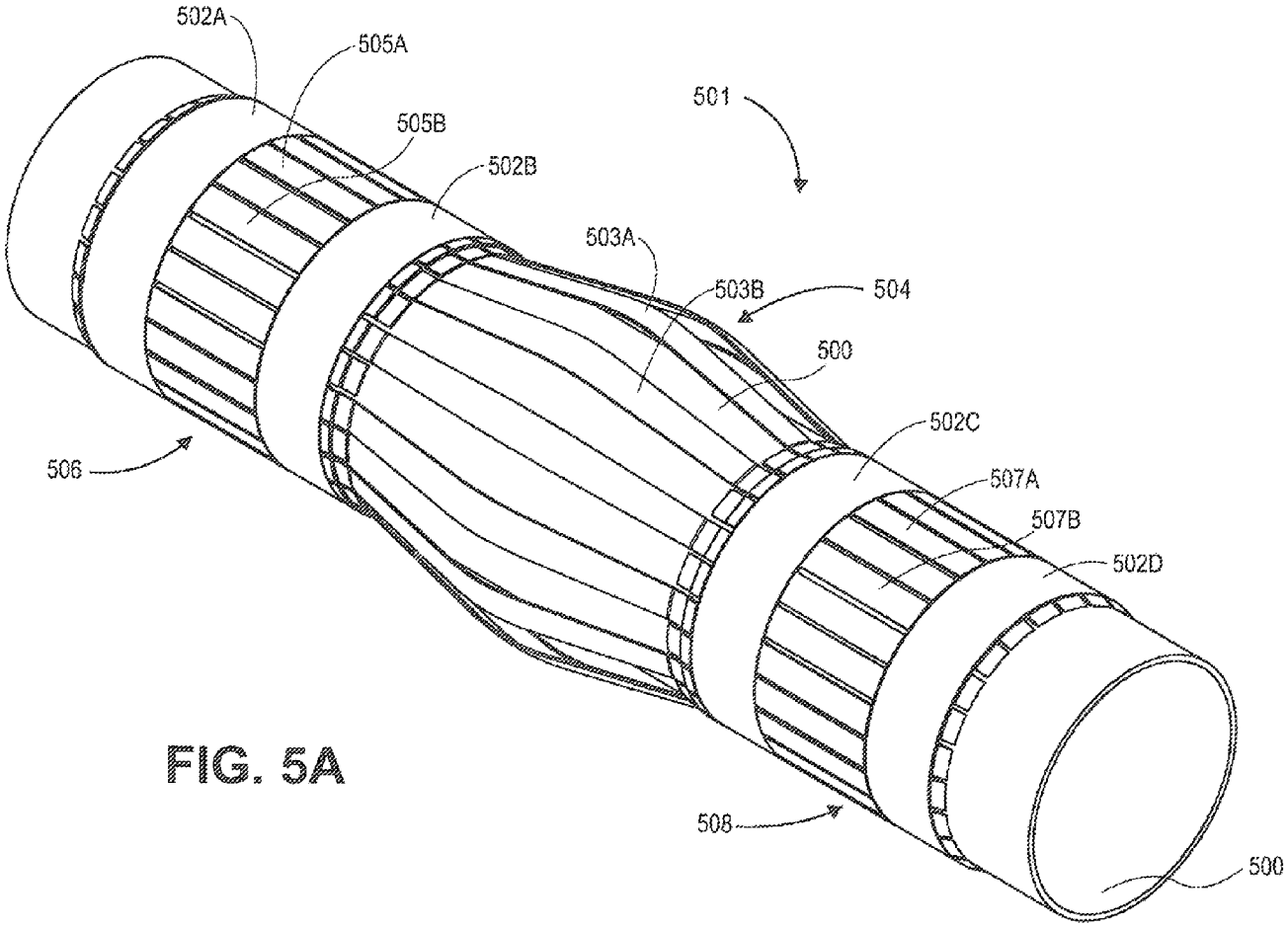
FIG. 5A illustrates a perspective view of a centralizer on an oilfield tubular, according to an embodiment.
Figure 5B:
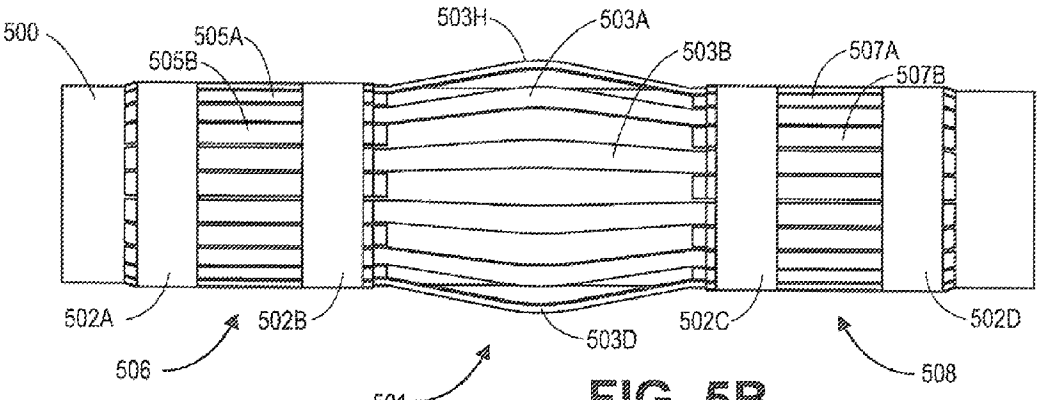
FIG. 5B illustrates a side view of the centralizer on the oilfield tubular, according to an embodiment.

FIGS. 5A and 5B depict a perspective view and a side view, respectively, of a centralizer 501 on an oilfield tubular 500, according to an embodiment. A plurality of ribs 503A, 503B, 503D, 503H may be positioned circumferentially apart from one another along the outer surface of the oilfield tubular 500. The ribs 503A, 503B, 503D, 503H may include a bow section 504 that is configured to engage a surrounding tubular in the wellbore.

A first plurality of spacers 505A, 505B may be positioned circumferentially apart from one another along the outer surface of the oilfield tubular 500. Each of the first plurality of spacers 505A, 505B may be positioned between two circumferentially adjacent ribs 503A, 503B, 503D, 503H. A second plurality of spacers 507A, 507B may also be positioned circumferentially apart from one another along the outer surface of the oilfield tubular 500. Each of the second plurality of spacers 507A, 507B may be positioned between two circumferentially adjacent ribs 503A, 503B, 503D, 503H. The first plurality of spacers 505A, 505B may be axially offset from the second plurality of spacers 507A, 507B with respect to the longitudinal axis of the oilfield tubular 500.

One or more elongated flexible members (two are shown: 502A, 502B) may be wrapped around the ribs 503A, 503B, 503D, 503H and the spacers 505A, 505B on a first side of the bow sections 504 of the ribs 503A, 503B, 503D, 503H. Although not shown in FIG. 5A, the elongated flexible members 502A, 502B may be positioned within grooves formed in the outer surfaces of the ribs 503A, 503B, 503D, 503H and the spacers 505A, 505B. Together, the ribs 503A, 503B, 503D, 503H, the spacers 505A, 505B, and the elongated flexible members 502A, 502B may form a first collar 506.

One or more elongated flexible members (two are shown: 502C, 502D) may also be wrapped around the ribs 503A, 503B, 503D, 503H and the spacers 507A, 507B on a second side of the middle sections 504 of the ribs 503A, 503B, 503D, 503H. Although not shown in FIG. 5A, the elongated flexible members 502C, 502D may be positioned within grooves formed in the outer surfaces of the ribs 503A, 503B, 503D, 503H and the spacers 507A, 507B. Together, the ribs 503A, 503B, 503D, 503H, the spacers 507A, 503B, and the elongated flexible members 502C, 502D may form a second collar 508 that is axially offset from the first collar 506 with respect to the longitudinal axis of the oilfield tubular 500.

Figure 5C:
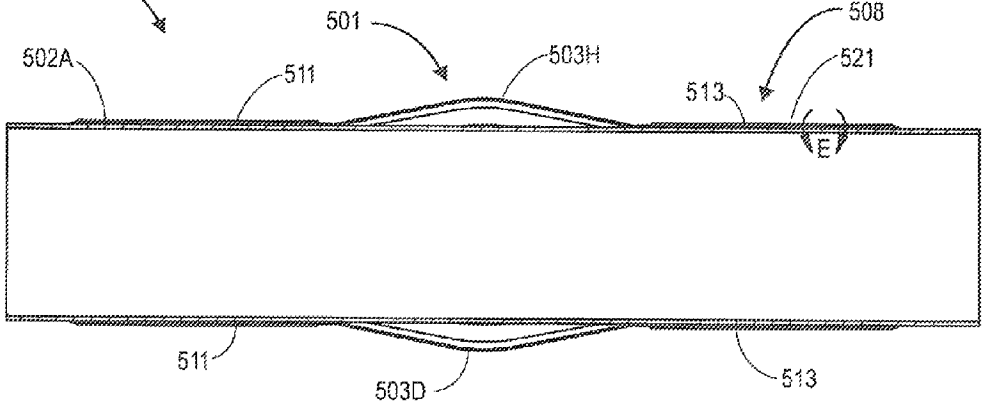
FIG. 5C illustrates a cross-sectional view of the centralizer on the oilfield tubular, according to an embodiment.
Figure 5D:
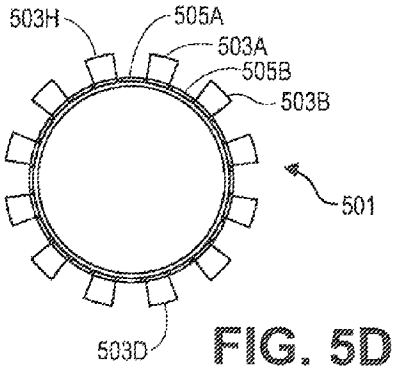
FIG. 5D illustrates an end view of the centralizer on the oilfield tubular, according to an embodiment.

FIGS. 5C and 5D depict a side cross-sectional view and an end view, respectively, of the centralizer 501 on the oilfield tubular 500, according to an embodiment. As shown, each spacer (e.g., spacer 505A) may be positioned circumferentially between two adjacent ribs (e.g., ribs 503H, 503A). Thus, as may be appreciated, the ribs 503A, 503B, 503D, 503H and spacers 505A, 505B, may continue around the circumference of the oilfield tubular 500 in alternating fashion. Although a single spacer (e.g., spacer 505A) is shown positioned circumferentially between two adjacent ribs (e.g., ribs 503H, 503A), it will be appreciated that in other embodiments no spacer, or two or more spacers, may be positioned circumferentially between two adjacent ribs (e.g., ribs 503H, 503A).

Figure 5E:
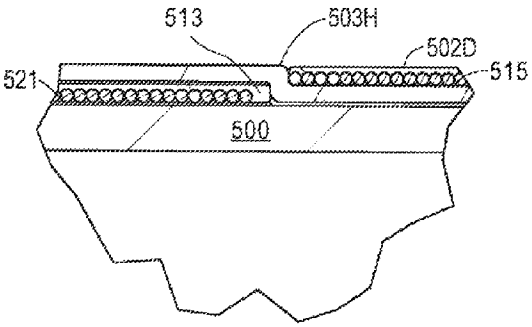
FIG. 5E illustrates a cross-sectional view of the centralizer on the oilfield tubular taken at circle "E" in FIG. 5C, according to an embodiment.

FIG. 5E illustrates a cross-sectional view of the centralizer 501 on the oilfield tubular 500 taken at circle "E" in FIG. 5C, according to an embodiment. The outer surface of the oilfield tubular 500 may include a protrusion 521 extending radially outward therefrom with respect to the longitudinal axis of the oilfield tubular 500. The protrusion 521 may be or include a first elongated flexible member that extends more than once (e.g., one 360 degree turn plus any fraction of a subsequent turn) around the oilfield tubular 500. For example, the first elongated flexible member may be wrapped (e.g., helically) around the outer surface of the oilfield tubular 500.

In another embodiment, the protrusion 521 may be or include a press-fit stop collar, for example, as disclosed in U.S. Patent Application Publication No. 2010/0326671, filed Apr. 8, 2010, which is hereby incorporated by reference in its entirety. In yet another embodiment, the protrusion 521 may be unitary with the oilfield tubular 500 by machining or otherwise forming the protrusion 521 in the outer surface of the oilfield tubular 500. In another embodiment, the protrusion 521 may be a metal-sprayed protrusion, an epoxy-formed protrusion, a pipe collar, etc.

In yet another embodiment, the protrusion 521 may include a shell. The shell may have an outer surface that is planar or outwardly-curved (e.g., convex), and the inner surface of the shell may include a plurality of projections, curved ridges, a fish scale pattern, or the like. The shell may be structurally reinforced with a strut, a brace, a rib, or the like that extends between two opposite sides of the shell. The shell may be formed from a composite material (e.g., a fiber-reinforced resin material), which may be surface-treated before molding of the shell. The shell may have at least one inlet configured to receive a liquid material such as a bonding agent The bonding agent may be used to couple the shell to the outer surface of the oilfield tubular 500. Additional details of the shell may be found in PCT Application No. PCT/EP2013/057416, filed Apr. 9, 2013, which is hereby incorporated by reference in its entirety.

The inner surfaces of the ribs (e.g., rib 503H) may have a recess 513 defined therein. The recess 513 may extend radially outward with respect to the longitudinal axis of the oilfield tubular 500. The ribs (e.g., rib 503H) may be positioned on the oilfield tubular 500 such that the protrusion 521 extends at least partially into the recess 513. Although not shown, the spacers 505A, 505B, 507A, 507B may also have a recess defined in the inner surface thereof, and the protrusion 521 may extend at least partially into the recess.

The outer surfaces of the ribs (e.g., rib 503H) may have a groove 515 defined therein. The groove 515 may extend radially inward with respect to the longitudinal axis of the oilfield tubular 500. The second elongated flexible member (e.g., 502D) may extend more than once around the outer surface of the oilfield tubular 500. The second elongated flexible member 502D may be positioned at least partially in the groove 515. Although not shown, the spacers 505A, 505B, 507A, 507B may also have a groove defined in the outer surface thereof, and the second elongated flexible member 502D may also be positioned at least partially in the grooves of the spacers 505A, 505B, 507A, 507B.

An adhesive may be placed in the recess 513 and/or in the groove 515. More particularly, the adhesive may be placed between the protrusion 521 and the outer surface of the oilfield tubular 500, between the inner surface of the ribs (e.g., rib 503H) and the protrusion 521, between the outer surface of the ribs (e.g., rib 503H) and the second elongated flexible member 517, or a combination thereof. The term "adhesive" as used herein includes, but is not limited to, an epoxy, glue, resin, polyurethane, cyanoacrylate, acrylic polymer, hot melt adhesive, contact adhesive, reactive adhesive, light curing adhesive, low temperature metal spray, thermal spraying, etc. The adhesive may be applied in any suitable manner, such as by spraying, brushing, rolling, etc. In some embodiments, the adhesive may be selected according to a desired coefficient of friction to provide reduced friction in use when contacting a wellbore. In other embodiments, the adhesive may be selected according to a desired hardness such that it protects the flexible member from damage when contacting a wellbore.

The term "flexible member" as used herein includes, but is not limited to, a cable, wire, string, cord, line, rope, band, braid, tape, and any member having the flexibility to be wrapped about the outer surface of the oilfield tubular 500. For example, the elongated flexible members 502A-D, 521 may be metal, plastic, fabric, composite, or any combination thereof. In an embodiment, the elongated flexible members 502A-D, 521 may be or include a steel (e.g., stainless steel) cable. The elongated flexible members 502A-D, 521 may have perforations therein to increase the bonding surface for the adhesive. The elongated flexible members 502A-D, 521 may be one unitary length of material to provide a desired holding force once it is wrapped and/or adhered on the oilfield tubular 500.

Figure 6B:
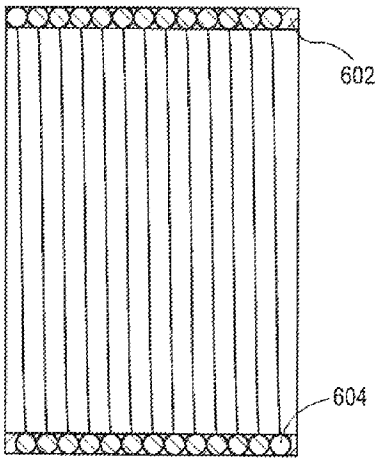
FIG. 6B illustrates a cross-sectional view of the flexible member and an adhesive, according to an embodiment.
Figure 6C:
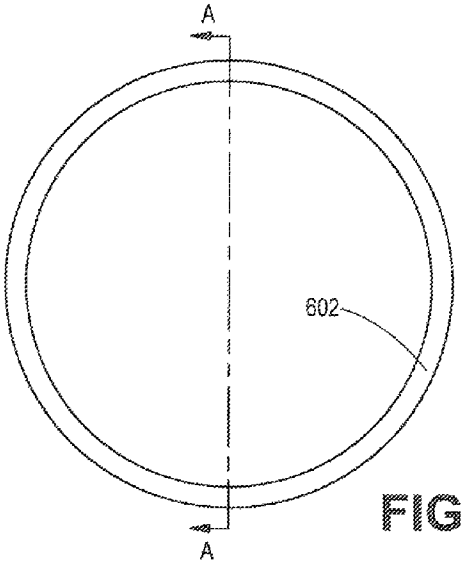
FIG. 6C illustrates an end view of the flexible member and the adhesive, according to an embodiment.
Figure 6A:
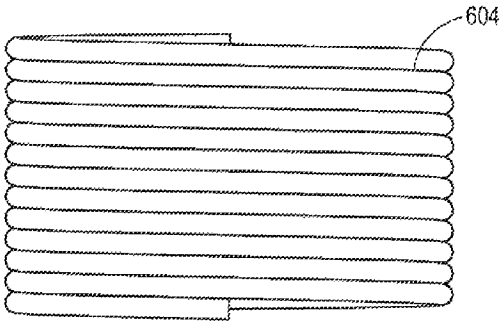
FIG. 6A illustrates a flexible member, according to an embodiment.

FIG. 6A illustrates a flexible member 604, according to one embodiment. The flexible member 604 is shown as it would be wound around a collar (e.g., 506, 508) in a laterally abutting orientation. In the depicted view of FIG. 6A, adjacent portions of the flexible member 604 are laterally abutting each other, and the ends of the flexible member 604 are visible. FIGS. 6B and 6C illustrate a cross-sectional view and an end view, respectively, of the flexible member 604 after an adhesive 602 is applied to the outer surface of the wound flexible member 604.

Figure 7:
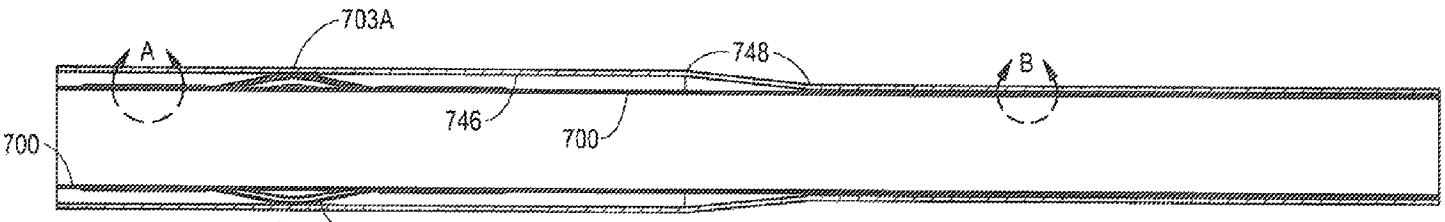
FIG. 7 illustrates a cross-sectional view of two centralizers positioned in a bore of a tubular having a restriction, according to an embodiment.

FIG. 7 illustrates a cross-sectional view of two wrap-around band centralizers 701A, 701B positioned in a bore 746 of a tubular having a restriction 748, according to an embodiment. The ribs 703A, 703B of the wrap-around band centralizer 701A are shown deployed (e.g., extended) to allow centralization in the bore 746 of the tubular.

Figure 7B:
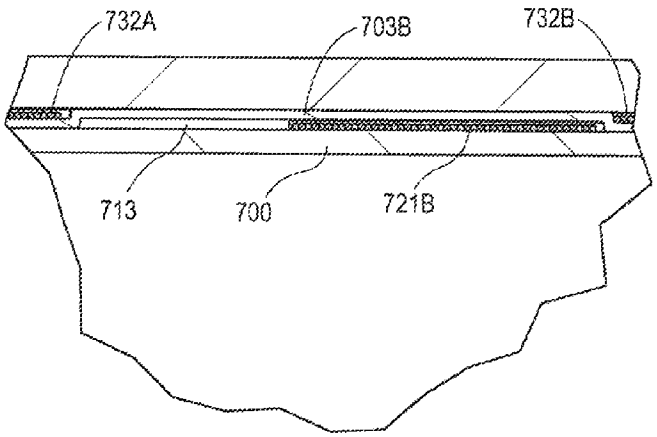
FIG. 7B illustrates a cross-sectional view of a second centralizer on the oilfield tubular taken at circle "B" in FIG. 7, according to an embodiment.
Figure 7A:
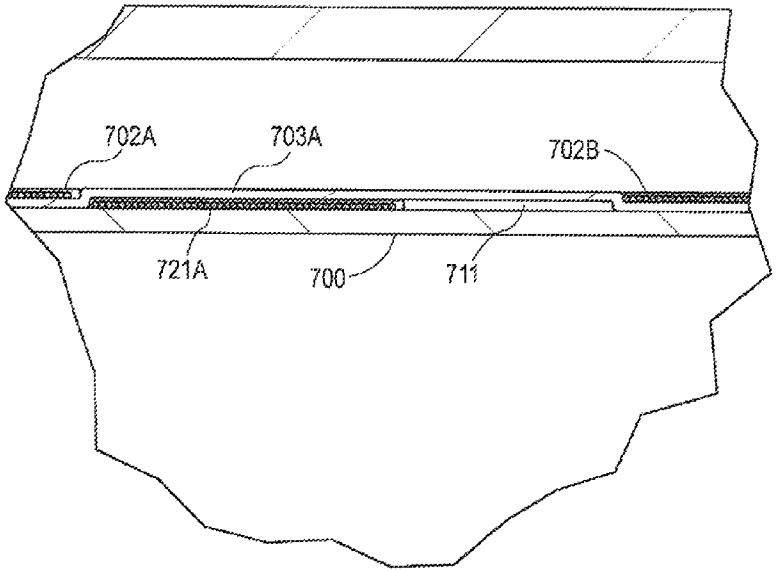
FIG. 7A illustrates a cross-sectional view of a first centralizer on the oilfield tubular taken at circle "A" in FIG. 7, according to an embodiment.

FIG. 7A illustrates a cross-sectional view of the first wrap-around band centralizer 701A on the oilfield tubular taken at circle "A" in FIG. 7, according to one embodiment. The wrap-around bands 702A, 702B may be positioned on opposing sides of the recess 711 on a first collar of the rib 703A to retain the first collar on the protrusion 721A. The protrusion 721A is positioned proximate to a first end of the recess 711 (e.g., left, as shown), indicating that the rib 703A is fully deployed.

FIG. 7B illustrates a cross-sectional view of a second wrap-around band centralizer 701B on the oilfield tubular 700 taken at circle "B" in FIG. 7, according to an embodiment. The wrap-around bands 732A, 732B may be on opposing sides of the recess 713 on a first collar of the rib 703B to retain the collar on the protrusion 721B. As opposed to FIG. 7A, the protrusion 721B in FIG. 7B is positioned proximate to a second end of the recess 713 (e.g., right, as shown), indicating that rib 703B is collapsed. Thus, the collars may slide axially relative to the protrusions 721A, 721B to allow the ribs 703A, 703B of the centralizer 701A, 701B to expand and collapse.

Figures 8A, 8B:
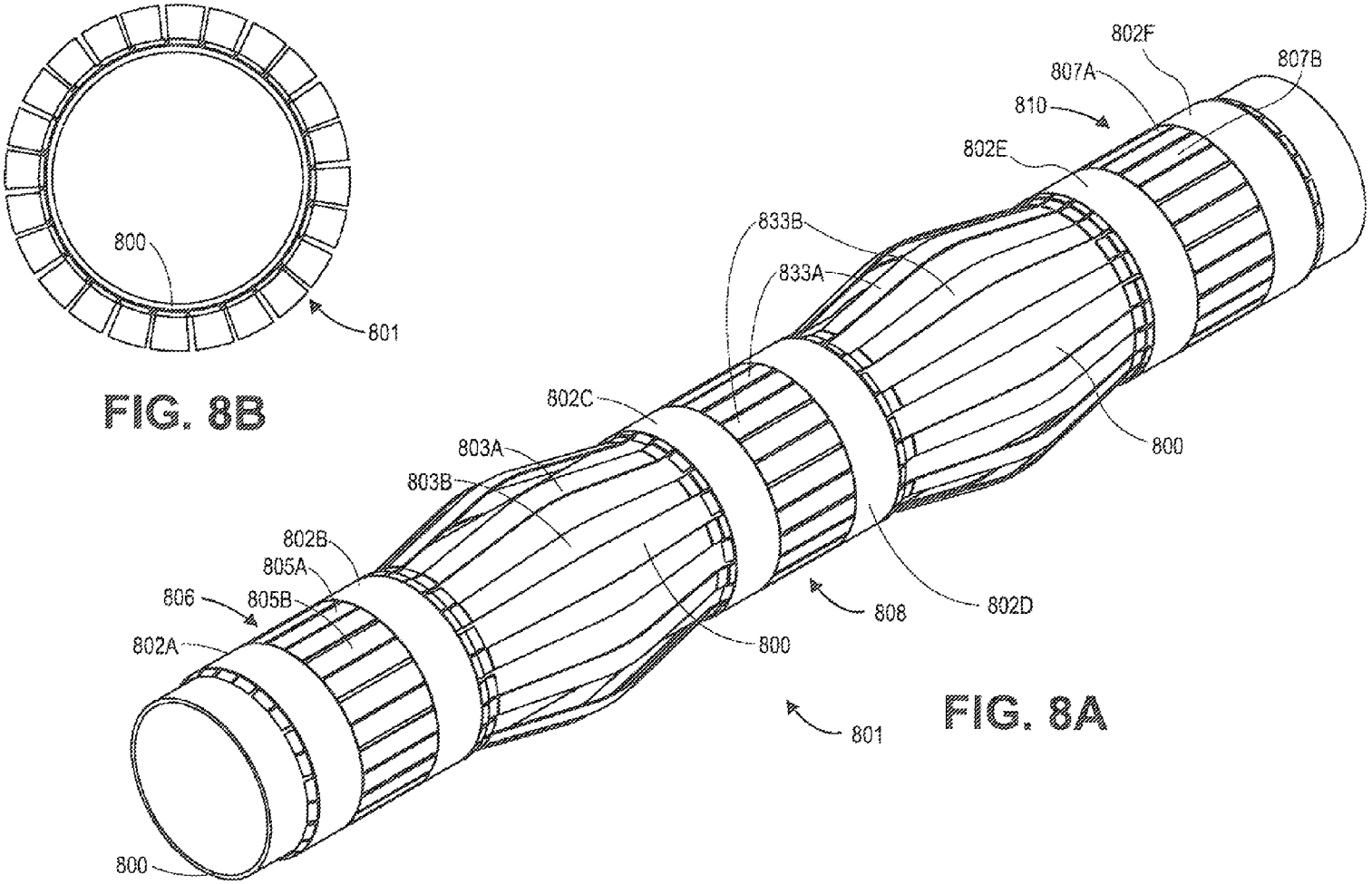
FIG. 8A illustrates a top view of a centralizer, according to an embodiment.
FIG. 8B illustrates an end view of the centralizer, according to an embodiment.

FIGS. 8A and 8B illustrate a perspective view and a top view, respectively, of a centralizer 801, according to an embodiment. The centralizer 801 may have one or more sets of ribs 803A, 803B and 833A, 833B. The ribs 803A, 803B may be axially offset from the ribs 833A, 833B. The rib 803A may be parallel to the rib 803B. Although a plurality of elongated flexible members 802A-802F are depicted, a single, all, or any combination of elongated flexible members may be used. In at least one embodiment, a shell, similar to the one described above with respect to PCT Application No. PCT/EP2013/057416, may be placed around the flexible members 802A-802F.

The centralizer 801 includes a first collar 806, second collar 808, and a third collar 810. In one embodiment, the end collars 806, 810 may each slidably receive a protrusion of the oilfield tubular 800 in a recess in the end collar 806, 810 to allow the centralizer 801 to be pulled through a restriction. In one embodiment, the center collar 808 may slidably receive a protrusion of the oilfield tubular 800 in a recess in the center collar 808. In the depicted embodiment, end collars 806, 810 include optional spacers 805A, 805B, 807A, 807B. Although not depicted, center collar 808 may also include one or more spacers.

Figure 9A:
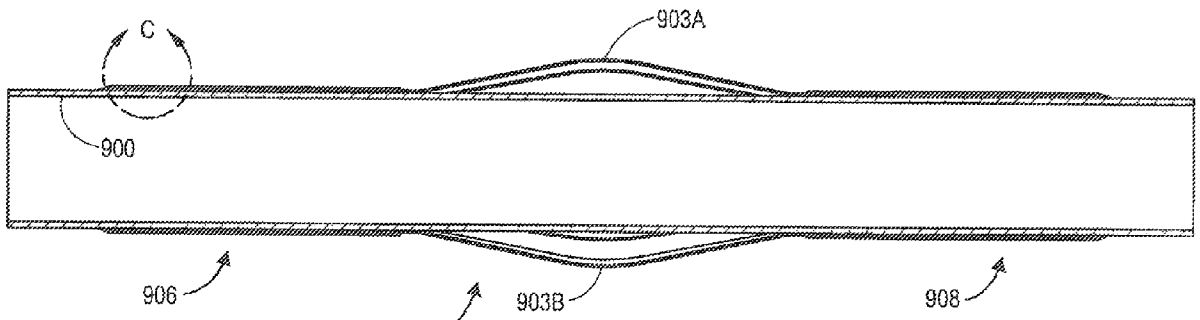
FIG. 9A illustrates a cross-sectional view of a centralizer being formed with a removable shim, according to an embodiment.
Figure 9B:
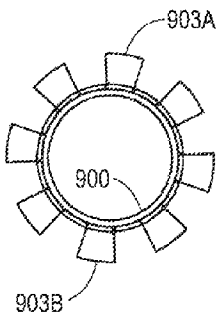
FIG. 9B illustrates an end view of the centralizer being formed with the removable shim, according to an embodiment.
Figure 9C:
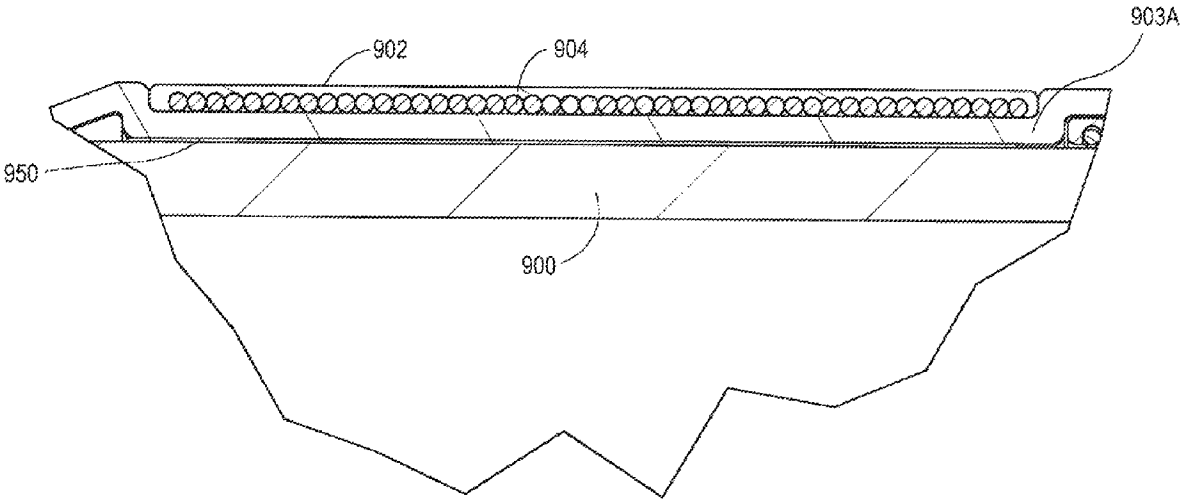
FIG. 9C illustrates a cross-sectional view of the centralizer being formed with the removable shim taken at circle "C" in FIG. 9A, according to an embodiment.

FIGS. 9A and 9B illustrate a cross-sectional view and an end view, respectively, of a centralizer 901 being formed with a removable shim 950, according to one embodiment. FIG. 9C illustrates a cross-sectional view of the centralizer 901 being formed with the removable shim 950 taken at circle "C" in FIG. 9A, according to one embodiment. The centralizer 901 may include the removable shim (e.g., an annular shim) 950 positioned radially between the collar 906, 908 and the outer surface of the oilfield tubular 900. The thickness of the removable shim 950 may be selected to provide a gap between the oilfield tubular 900 and the collar to allow sliding and/or rotation between the collar and the oilfield tubular 900. The removable shim 950 may be positioned over the protrusion and/or the non-protruded part of the oilfield tubular 900. In one embodiment, the shim 950 may be configured to melt when exposed to a predetermined temperature. For example, the shim 950 may be made of paraffin. The shim 950 may be installed before the installation of the ribs 903A, 903B and/or the elongated flexible members. In one embodiment, the shim 950 may be melted after at least a portion of the adhesive on the centralizer 901 cures. The shim 950 may have properties such that the temperature used to melt the shim 950 does not create a heat affected zone and/or damage a coating on the inner and/or outer surface of the oilfield tubular 900, for example, a low-friction coating on an inner surface of an oilfield tubular 900 as is known to be used with expandable oilfield tubulars.

Figures 10A, 10B, 10C:
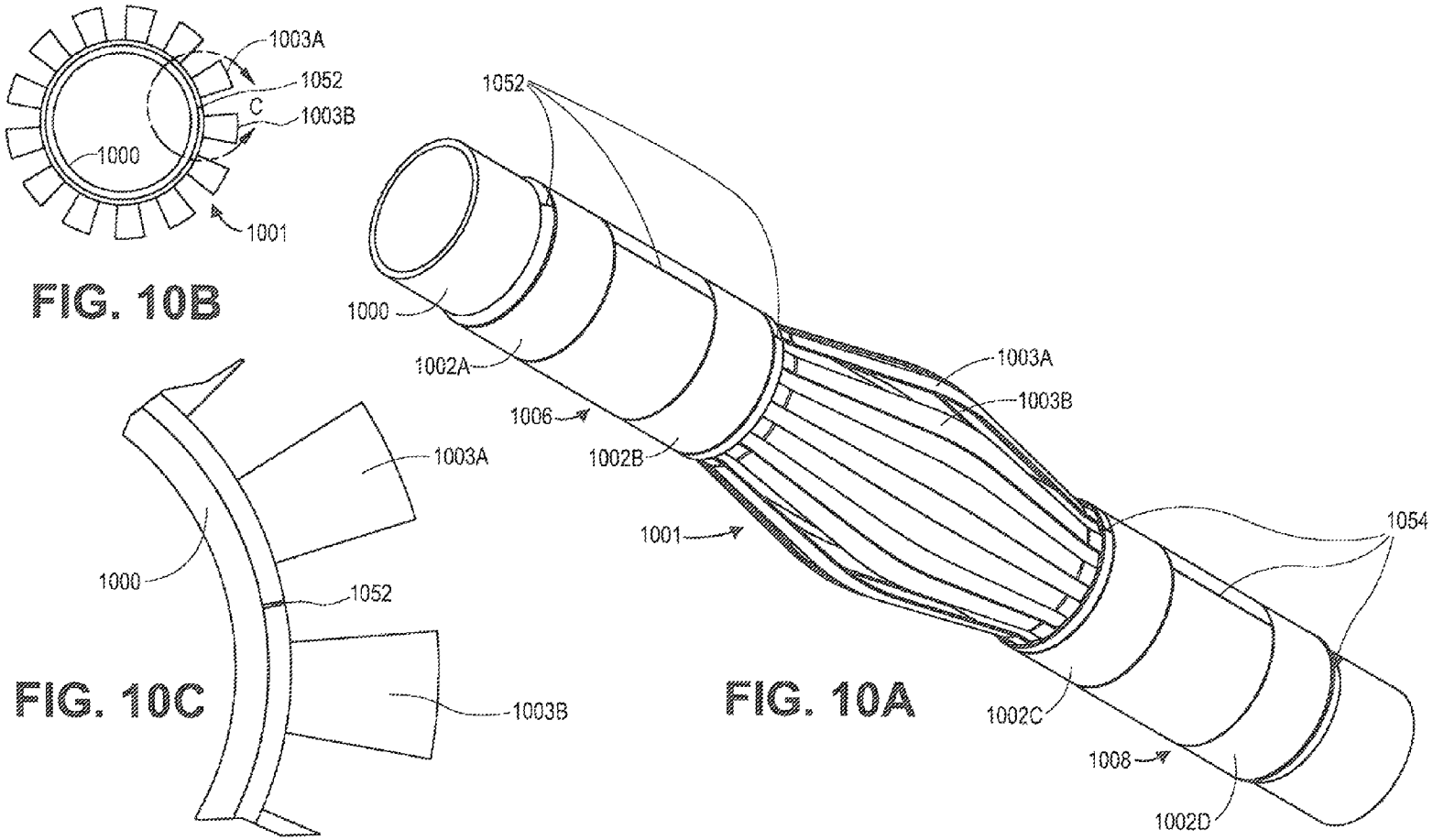
FIG. 10A illustrates a top view of a centralizer, according to an embodiment.
FIG. 10B illustrates an end view of the centralizer, according to an embodiment.
FIG. 10C illustrates an enlarged view of the centralizer taken at circle "C" in FIG. 10B, according to an embodiment.

FIGS. 10A and 10B illustrate a top view and an end view, respectively, of a centralizer 1001, according to one embodiment. FIG. 10C illustrates a zoomed in view of the centralizer 1001 taken at circle "C" in FIG. 10B, according to one embodiment. The centralizer 1001 may have a single axial split 1052, 1054 in each respective collar 1006, 1008. The axial splits 1052, 1054 may be coincident (e.g., extending along the same line). The axial splits 1052, 1054 may be axially offset from each other. The ribs 1003A, 1003B may extend from the first collar 1006 to the second collar 1008. Although a plurality of elongated flexible members 1002A-D are depicted, a single, all, or any combination of the elongated flexible members may be used. In one embodiment, at least one collar 1006, 1008 may slidably receive a protrusion of the oilfield tubular 1000 in a recess in the collar 1006, 1008 to allow the centralizer 1001 to pass through a restriction.

The first collar 1006, the second collar 1008, and the plurality of ribs 1003A, 1003B may be formed as a unitary component. For example, a single sheet of material may have holes formed therein to form the ribs 1003A, 1003B. The ribs 1003A, 1003B may then be plastically deformed to provide a desired positive outer protrusion, and the entire assembly may be rolled into a desired (e.g., cylindrical) shape for use on an oilfield tubular. As such, the axial splits 1052, 1054 in each respective collar 1006, 1008 may be the opposing edges of the original sheet. A recess may be formed in one or more of the collars 1006, 1008 by machining or plastic deformation.

In one embodiment, the collar 1006, 1008 may be formed from a single sheet of material by forming the sheet into the collar 1006, 1008 such that the axial split 1052, 1054 is formed from the opposing edges of the sheet. A recess may be formed in the collar 1006, 1008, for example, by machining or plastic deformation (e.g., metal deformation such as rolling). The ribs 1003A, 1003B may be attached to the collars 1006, 1008 by any means known in the art.

Figure 11:
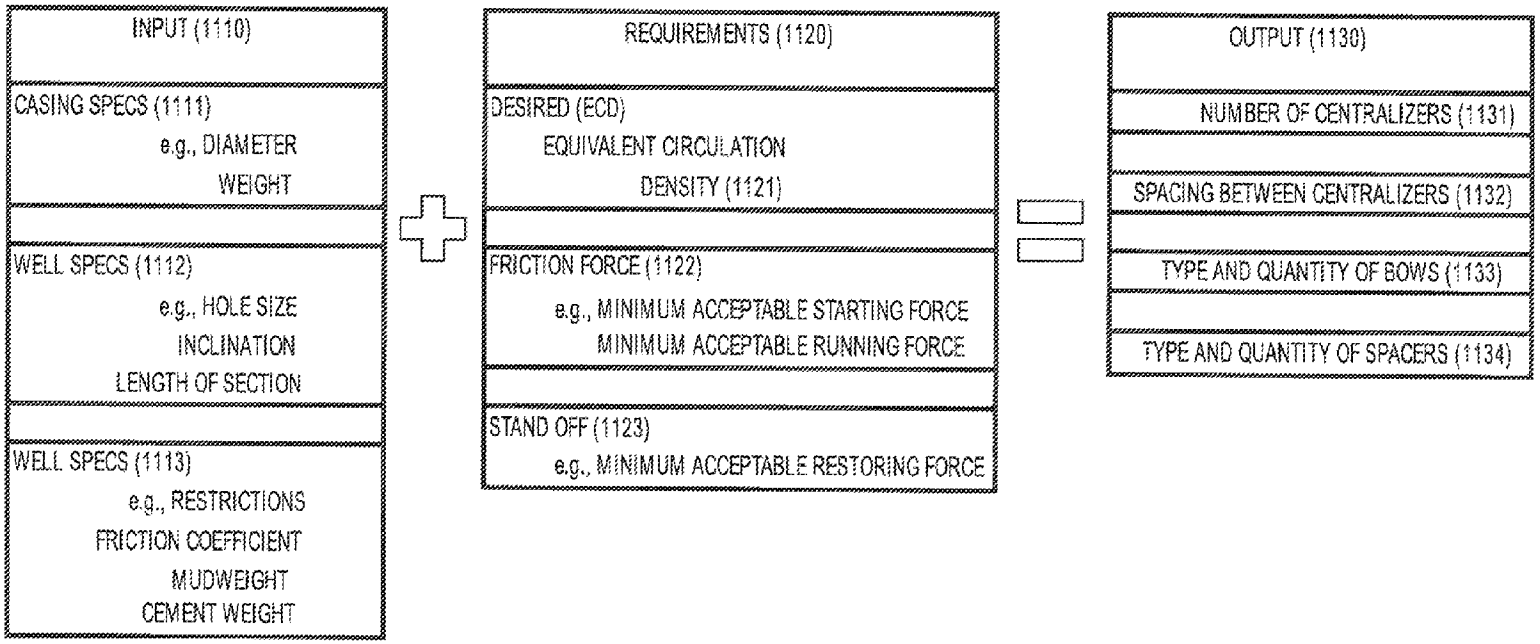
FIG. 11 illustrates a flow chart for outputting a centralizer plan, according to an embodiment.

FIG. 11 illustrates a flow chart for outputting a centralizer plan 1100, according to one embodiment. As depicted, the centralizer plan may allow the components from a given set of ribs and/or spacers to be output 1130 in response to a user's inputs 1110 and requirements 1120. For example, the specifications 1111 of the tubular that will be centralized may be input (e.g., by the user). This step may include inputting the inner and/or outer diameter and weight of the tubular. The well specifications 1112, such as the diameter of the wellbore, the inclination of the wellbore, and/or the length of the section of wellbore, may be input (e.g., by the user). The well parameters 1113, such as the inner diameter of any restrictions the tubular will pass through, the friction coefficient (e.g., of the restriction and/or inner wellbore), the mud weight, and/or the cement slurry weight, may be input (e.g., by the user).

The step of inputting requirements 1120 may include inputting of the desired equivalent circulating density (ECD) 1121. The friction force 1122, such as the maximum acceptable starting force and/or the maximum acceptable running force, may be input. The stand off 1123 (e.g., the minimum acceptable restoring force) may be input. After all desired parameters and requirements are input, the method disclosed here may then output 1130 a desired centralizer plan. For example, the method may output the number of centralizers 1131, the axial spacing between each centralizer 1132, the type (e.g., length, width, or other size) and quantity of ribs 1133, and/or the type (e.g., length width, or other size) and quantity of spacers 1134. For example, the output 1130 may be used as an assembly list to allow the forming of the centralizers along the oilfield tubular. For example, the output 1130 may include the quantity and/or type of ribs (and the quantity and/or type of any spacers needed) to allow the forming of each centralizer.

The centralizer may be retained on the oilfield tubular (e.g., radially and/or axially fixed within a range of movement on the oilfield tubular) by the circumferential force provided by the adhesive and/or flexible member (e.g., locking a collar around a protrusion). The centralizer may not be dependent on the cross-sectional length of the oilfield tubular. This may allow a set of ribs and/or spacers to be used to accommodate any cross-sectional length. For example, the cross-section of the oilfield tubular may be circular, square, rectangular, ovate, irregular, polygonal, egg-shaped, etc. As a further example, if the oilfield tubular does not have a circular cross-section, a premade, rigid circular collar centralizer may not fit, whereas certain embodiments herein will fit.

The collars of the centralizer do not need to be machined to predetermined sizes. The centralizer that may be usable with all cross-sectional shapes and sizes. Components for the centralizer do not need to be premade for specific, different outer diameters of oilfield tubulars. The assembly of the centralizer does not creating a heat affected zone (e.g., generated from welding) where there are metallurgical changes in the oilfield tubular, for example, a mechanically weaker zone.

A desired inner diameter of collars may be formed from a standard (e.g., uniform) set of ribs and/or spacers. In other words, a collar may be provided that is adjustable with the addition of ribs and/or spacers to form a desired inner diameter. For example, a set of ribs and/or spacers having a uniform width, such as one or one and a half inches, may be all of the ribs and/or spacers that are used in a centralizer. In one embodiment, a method includes inputting a desired centralizer inner diameter (or the outer diameter of an oilfield tubular), and having a processor calculate and output the quantity of ribs and/or spacers of a specific size to create a desired wrap-around band centralizer.

The centralizer may be adjustable (e.g., during installation without machining, cutting, etc.) to fit a certain outer diameter of tubular (e.g., fitting any tubular in a range of 5" to 20" of outer diameter). The positive outer protrusion of the centralizer from the outer surface of the oilfield tubular may be about the radial thickness of the flexible member, e.g., when it is installed on the oilfield tubular, plus the thickness of the collars. For example, the positive outer protrusion of the collars of the centralizer may be less than 3/16 of an inch or less than 1/8 of an inch.

The centralizer may be installed anywhere on the oilfield tubular. For example, it is not limited to be positioned near an upset connection. The centralizer may be used with oilfield tubulars having an outer diameter upset and those that do not have an outer diameter upset (e.g., non-upset). The centralizer may be used on a standard (e.g., standard length and/or grade) oilfield tubular without requiring a separate shorter oilfield tubular (e.g., referred to as a sub in oilfield parlance). Such a sub changes the length of a joint or stand of oilfield tubulars, which may cause compatibility issues with: existing equipment on a drilling rig, transportation (e.g., the oilfield tubular with connected sub being longer than a standard length trailer and/or requiring special permits), adding undesirable rigidity to the oilfield tubular formed from joints or stands of oilfield tubulars and the sub, and adding cost, e.g., the cost of additional material for a sub and threads formed in the sub.

The flexible member (e.g., cable) may be selected as a similar or the same material as the oilfield tubular and/or ribs to have substantially the same expansion coefficient when exposed to variations in pressure and/or temperature. A desired holding three may be provided to retain the centralizer around the oilfield tubular by selecting a number of turns the flexible member is wrapped around a collar.

Figure 12:
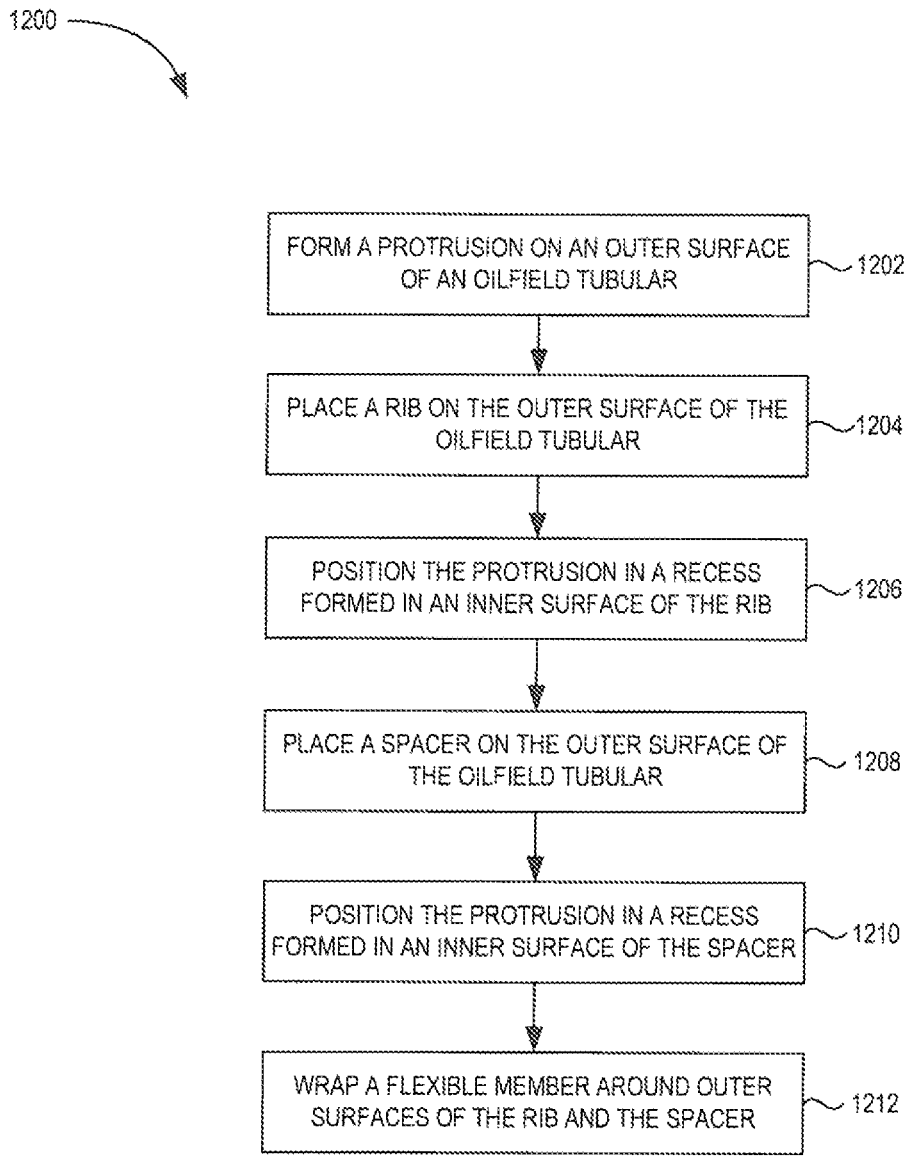
FIG. 12 illustrates a flow chart of a method for forming a centralizer, according to an embodiment.

FIG. 12 illustrates a flowchart of a method 1200 for forming a centralizer, according to an embodiment. A protrusion may be formed on the outer surface of the oilfield tubular, as at 1202. In at least one embodiment, a first elongated flexible member may extend more than once around the outer surface and the oilfield tubular to form the protrusion. An adhesive may be placed between the oilfield tubular and the first elongated flexible member, over the first elongated flexible member, or a combination thereof. In other embodiments, the protrusion may be formed using a stop collar, which may be fastened or clamped to the oilfield tubular, or may form an interference-fit therewith.

One or more ribs may then be placed on the outer surface of the oilfield tubular, as at 1204. The ribs may be positioned such that the protrusion is at least partially received in a recess formed in the inner surfaces of the ribs, as at 1206. One or more spacers may also be placed on the outer surface of the oilfield tubular, as at 1208. More particularly, each spacer may be positioned circumferentially between two adjacent ribs. The spacers may be positioned such that the protrusion is at least partially received in a recess formed in the inner surfaces of the spacers, as at 1210.

A second elongated flexible member may then be wrapped around the ribs and the spacers, as at 1212. More particularly, the second elongated flexible member may be wrapped helically within a groove in the outer surfaces of the ribs and the spacers to secure the ribs and the spacers in place.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A centralizer for centralizing a tubular in a wellbore, comprising:

a plurality of ribs spaced circumferentially apart from one another around the tubular, each of the ribs comprising a first end section, a second end section, and a middle section extending between the first and second end sections, wherein each of the first end sections comprises an inner surface that contacts an outer surface of the tubular, and wherein the inner surface defines a recess that extends radially outward with respect to a longitudinal axis of the tubular; and a first plurality of spacers spaced circumferentially apart from one another around the tubular, wherein each of the first plurality of spacers is positioned circumferentially between two of the plurality of ribs, and wherein the first plurality of spacers and the first end sections of the plurality of ribs are axially aligned and together at least partially define a first end collar.

2. The centralizer of claim 1, further comprising a second plurality of spacers spaced circumferentially apart from one another around the tubular, wherein each of the second plurality of spacers is positioned circumferentially between two of the plurality of ribs, and wherein the second plurality of spacers and the second end sections of the plurality of ribs are axially aligned and together at least partially define a second end collar.

3. The centralizer of claim 2, wherein the first end collar is axially spaced apart from the second end collar along the tubular.

4. The centralizer of claim 1, wherein the outer surface of the tubular comprises a protrusion that extends radially outward with respect to the longitudinal axis of the tubular, and wherein each of the first end sections is positioned such that the protrusion is received within the recess.

5. The centralizer of claim 4, wherein the protrusion comprises an elongated flexible member that is wrapped around the tubular.

6. The centralizer of claim 5, wherein the elongated flexible member extends circumferentially around the tubular more than once.

7. The centralizer of claim 5, wherein the elongated flexible member is wrapped helically around the tubular.

8. The centralizer of claim 5, further comprising an adhesive positioned between the outer surface of the tubular and the elongated flexible member.

9. The centralizer of claim 1, wherein the outer surface of each of the first ends defines a groove that extends radially inward with respect to a longitudinal axis of the tubular.

10. The centralizer of claim 9, further comprising an elongated flexible member that is wrapped around the tubular, wherein the elongated flexible member is received within the groove.

11. The centralizer of claim 10, wherein the elongated flexible member is wrapped helically around the tubular.

12. The centralizer of claim 1, wherein the middle section is configured to engage a surrounding tubular.

13. The centralizer of claim 1, wherein the plurality of ribs and the plurality of spacers are configured to move axially and rotationally with respect to the tubular.

14. A centralizer for centralizing a tubular in a wellbore, comprising:

a plurality of ribs spaced circumferentially apart from one another around the tubular, each of the ribs comprising:

a first end section;

a second end section, wherein the first end section, the second end section, or both comprises:

an inner surface that contacts an outer surface of the tubular, wherein the inner surface defines a first recess that extends radially outward with respect to a longitudinal axis of the tubular, and wherein the first recess at least partially receives a protrusion extending radially outward from the outer surface of the tubular; and an outer surface opposing the inner surface, wherein the outer surface defines a first groove that extends radially inward with respect to the longitudinal axis of the tubular; and a middle section extending between the first and second end sections, wherein the middle section comprises a bow shape and is configured to engage a surrounding tubular in the wellbore;

a plurality of spacers spaced circumferentially apart from one another around the tubular, wherein each of the plurality of spacers is positioned circumferentially between two of the plurality of ribs, and wherein the plurality of spacers and the first end sections of the plurality of ribs together at least partially define a first end collar; and an elongated flexible member wrapped around the tubular and the plurality of ribs, wherein the elongated flexible member is positioned at least partially within the first groove.

15. The centralizer of claim 14, wherein each of the plurality of spacers comprises:

an inner surface that contacts the outer surface of the tubular and defines a second recess that extends radially outward with respect to the longitudinal axis of the tubular, and wherein the second recess at least partially receives the protrusion; and an outer surface opposing the inner surface, wherein the outer surface defines a second groove that extends radially inward with respect to the longitudinal axis of the tubular.

16. The centralizer of claim 15, wherein the elongated flexible member is positioned at least partially within the second groove.

17. The centralizer of claim 14, wherein the elongated flexible member is wrapped helically around the tubular.

18. A method of forming a centralizer on a tubular, comprising:

wrapping an elongated flexible member around the tubular to form a protrusion on an outer surface of the tubular;

placing a plurality of ribs on the outer surface of the tubular, wherein the ribs each comprise first and second end sections and a middle section extending between the first and second end sections;

positioning the plurality of ribs such that the protrusion is at least partially received in a recess formed in an inner surface of the plurality of ribs;

placing a plurality of spacers on the outer surface of the tubular, wherein each of the plurality of spacers is positioned between two of the plurality of ribs, wherein the plurality of spacers and the first end sections of the plurality of ribs together at least partially define a first end collar; and securing the plurality of spacers and the plurality of ribs around the tubular.

19. The method of claim 18, wherein securing the plurality of spacers and the plurality of ribs around the tubular comprises wrapping an elongated flexible member around the plurality of spacers and the plurality of ribs.

20. The method of claim 19, wherein the elongated flexible member is positioned at least partially in a groove formed in an outer surface of the plurality of ribs.

21. The method of claim 20, wherein the elongated flexible member is wrapped helically around the plurality of spacers and the plurality of ribs.

22. The method of claim 18, wherein the middle section is configured to engage a surrounding tubular when the centralizer is deployed into a wellbore.

* * * * *